US007856691B2

(12) United States Patent
Viggiani

(10) Patent No.: US 7,856,691 B2
(45) Date of Patent: Dec. 28, 2010

(54) PAINTING APPLICATION SYSTEM

(75) Inventor: Anthony Viggiani, Southwest Ranches, FL (US)

(73) Assignee: Eclipse Home Decor, LLC, Delray Beach, FL (US)

( * ) Notice: Subject to any disclaimer, the term of this patent is extended or adjusted under 35 U.S.C. 154(b) by 81 days.

(21) Appl. No.: 12/315,388

(22) Filed: Dec. 4, 2008

(65) Prior Publication Data

US 2010/0139558 A1 Jun. 10, 2010

(51) Int. Cl.
*B05C 17/00* (2006.01)

(52) U.S. Cl. ..... 15/118; 15/143.1; 15/144.1; 15/145; 15/210.1

(58) Field of Classification Search ..... 15/106, 15/114, 118, 143.1, 144.1–144.4, 145, 209.1, 15/210.1
See application file for complete search history.

(56) References Cited

U.S. PATENT DOCUMENTS

| | | | |
|---|---|---|---|
| 181,206 | A | 8/1876 | Richardson |
| 471,562 | A | 3/1892 | Minnerly |
| 812,740 | A | 2/1906 | Harris et al. |
| 1,421,478 | A | 7/1922 | Hope |
| 1,605,305 | A | 11/1926 | Vinje |
| D117,933 | S | 12/1939 | Manchester et al. |
| 2,533,838 | A | 12/1950 | Ranft |
| 2,603,991 | A | 7/1952 | Oliver |
| 2,711,098 | A | 6/1955 | Ames |
| 2,712,145 | A | 7/1955 | Karnes |
| 2,739,334 | A | 3/1956 | Hardey |
| 2,887,710 | A | 5/1959 | Mahoney |
| 2,975,453 | A | 3/1961 | Imhof |
| 3,172,140 | A | 3/1965 | Burns et al. |
| 3,214,779 | A | 11/1965 | Wheeler |
| 3,369,268 | A | 2/1968 | Burns et al. |
| 3,388,415 | A | 6/1968 | Warner et al. |
| 3,413,043 | A | 11/1968 | Bertolina |
| 3,414,929 | A | 12/1968 | Warner et al. |
| 3,473,183 | A | 10/1969 | Burns et al. |
| D218,388 | S | 8/1970 | Whitaker |
| 3,629,894 | A | 12/1971 | Stefany |
| 3,708,821 | A | 1/1973 | Chase et al. |
| 3,720,976 | A | 3/1973 | Bailey |
| 3,736,616 | A | 6/1973 | Seip |
| 3,874,021 | A | 4/1975 | Jacobs |
| 4,041,564 | A | 8/1977 | Schlicher |
| 4,127,911 | A | 12/1978 | Cupp et al. |
| 4,134,171 | A | 1/1979 | Love |
| 4,155,140 | A | 5/1979 | Janssen et al. |
| 4,157,598 | A | 6/1979 | Talent et al. |
| 4,194,852 | A | 3/1980 | Cupp et al. |
| 4,215,448 | A | 8/1980 | Burns et al. |
| 4,219,899 | A | 9/1980 | Zurawin et al. |
| 4,244,074 | A | 1/1981 | Barcikowski et al. |

(Continued)

*Primary Examiner*—Mark Spisich
(74) *Attorney, Agent, or Firm*—Dan M. DeLaRosa

(57) ABSTRACT

A painting system is provided and the system comprises: a first application device comprising opposing sides, the first application device comprises a pole adaptor directly and pivotably attached to the first side of the first application device, and the second side of the first application device is adaptable to receive a paint pad; and a second application device comprising opposing sides, the second application device comprises a handle situated on the first side of the second application device, and the second side of the second application device has a cavity for receiving the pole adaptor when the second application device is attached to the first application device.

20 Claims, 7 Drawing Sheets

U.S. PATENT DOCUMENTS

| | | | |
|---|---|---|---|
| 4,517,700 | A | 5/1985 | Pinto |
| 4,658,461 | A | 4/1987 | Roe et al. |
| 4,727,618 | A | 3/1988 | Mahoney |
| 4,741,064 | A | 5/1988 | Riegert et al. |
| 4,819,294 | A | 4/1989 | Calvert |
| 4,822,194 | A | 4/1989 | Simonette |
| 5,010,618 | A | 4/1991 | Croft |
| 5,117,527 | A | 6/1992 | Milkie |
| 5,134,745 | A | 8/1992 | Burns et al. |
| 5,209,781 | A | 5/1993 | Milkie |
| 5,267,369 | A | 12/1993 | O'Neil et al. |
| 5,293,662 | A | 3/1994 | Newman, Sr. et al. |
| 5,331,710 | A | 7/1994 | Tollasepp |
| 5,351,350 | A | 10/1994 | Johnson |
| 5,495,635 | A | 3/1996 | Williams |
| 5,556,470 | A | 9/1996 | Gruber |
| 5,575,030 | A | 11/1996 | Girard |
| 5,894,624 | A | 4/1999 | Fulenwider |
| 5,966,772 | A | 10/1999 | Woodnorth et al. |
| 6,014,785 | A | 1/2000 | Punch et al. |
| 6,076,225 | A | 6/2000 | Sorenson |
| 6,530,107 | B2 | 3/2003 | Kim |

PAINTING APPLICATION SYSTEM

BACKGROUND OF THE INVENTION

1. Field of the Invention

The present invention relates to a paint application system and more particularly, a diverse and interchangeable painting system which allows for the use of two application devices with different sizes, two pads with different sizes and a removable pole.

2. Description of the Related Art

There are numerous paint devices and systems in the art. The present invention provides for a paint application system that has interchangeable and removable components and provides for diverse uses.

SUMMARY OF THE INVENTION

In one embodiment, the present invention provides for a paint application system comprising: a first application device comprising opposing sides, the first application device comprises a pole adaptor directly and pivotably attached to the first side of the first application device, and the second side of the first application device is adaptable to receive a paint pad; and a second application device comprising opposing sides, the second application device comprises a handle situated on the first side of the second application device, and the second side of the second application device has a cavity for receiving the pole adaptor when the second application device is attached to the first application device.

In another embodiment, the system further comprises an interchangeable paint pad designed to be attached to and removable from the second side of the first application device. In yet another embodiment, the second side of the second application device is adapted to receive a paint pad, and the system further comprises an interchangeable paint pad designed to be attached to and removable from the second side of the second application device.

In still another embodiment, the system further comprises a pole, and the pole is designed to be attach to the pole adaptor and used with the first application device. In still another embodiment, the pole is an extendable pole. For purposes of the invention, any extendable pole may be used, including but not limited to, telescoping poles, connectable poles, pulley driven poles, etc.

In a further embodiment, the system further comprises means for attaching the second application device to the first application device. For purposes of the invention, any system can be used to connect and secure the second application device to the first application device. In another further embodiment, the second side of the second application device is attached to the first side of the first application device.

In yet a further embodiment, the means for attaching the second application device to the first application device is selected from a group consisting essentially of snap-ons, clips, adhesives, slide and lock mechanisms, screws, bolts, hooks and loops, tabs, pins, and other related mechanisms and devices. The first and second application devices can be attached to one another using various means, devices and mechanisms. The present invention is not limited to one type of attachment means, device or mechanism.

In still a further embodiment, the first side of the first application device comprises at least one indentation and the second side of the second application device comprises at least one protrusion, and the protrusion is adapted to fit within the indentation and secure the second application device to the first application device.

In still yet a further embodiment, the first application device further comprises a lock, and the lock is situated on the first side of the application device and is adapted to engage at least a portion of the second application device to lock the second application device to the first application device.

In another embodiment, the first side of the first application device comprises an extended portion, and the extended portion comprises a cavity, at least a portion of the second application device comprises a pointed end, and the pointed end of the second application device is adapted to be received within the cavity of the extended portion when the second application device is attached to the first application device.

In yet another embodiment, the system further comprises a pole, and wherein the first application device, the pad and the pole are designed to work as a system for painting.

In still another embodiment, the second application device and the pad are designed to work as a system for painting.

In still yet another embodiment, the first application device, the pad and the second application device are designed to work as a system for painting.

In a further embodiment, at least a portion of the first application device comprises a narrowed end and the pad comprises a pointed end, and the pointed end of the pad is situated adjacent to the narrowed end of the first application device when the pad is attached to the first application device. In another further embodiment, at least a portion of the second application device comprises a narrowed end and the pad comprises a pointed end, the pointed end of the pad is situated adjacent to the narrowed end of the second application device when the pad is attached to the second application device.

In yet another further embodiment, the second application device is smaller in size relative to the first application device. In still another further embodiment, the pole adaptor is rotatable around an axis point situated on the first side of the first application device.

In still yet another further embodiment, the present invention provides for a painting system comprising: a first application device comprising opposing sides, the first application device comprises a pole adaptor directly and pivotably attached to the first side of the first application device; a first paint pad adapted to fit on the second side of the first application device; a second application device comprising opposing sides, the second application device comprises a handle situated on the first side of the second application device, the second side of the second application device has a cavity for receiving the pole adaptor when the second application device is attached to the first application device; and a second paint pad adapted to fit on the second side of the second application device when the second application device is separated from the first application device.

In another further embodiment, the present invention also relates to a painting system comprising: a first application device comprising opposing sides, the first application device comprises a pole adaptor directly and pivotably attached to the first side of the first application device; a first paint pad adapted to fit on the second side of the first application device; a second application device comprising opposing sides, the second application device comprises a handle situated on the first side of the second application device, the second side of the second application device has a cavity for receiving the pole adaptor when the second application device is attached to the first application device; a second paint pad adapted to fit on the second side of the second application device when the second application device is separated from the first application device; and a pole adapted to be attached to the pole adaptor when the second application device is separated from the first application device.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
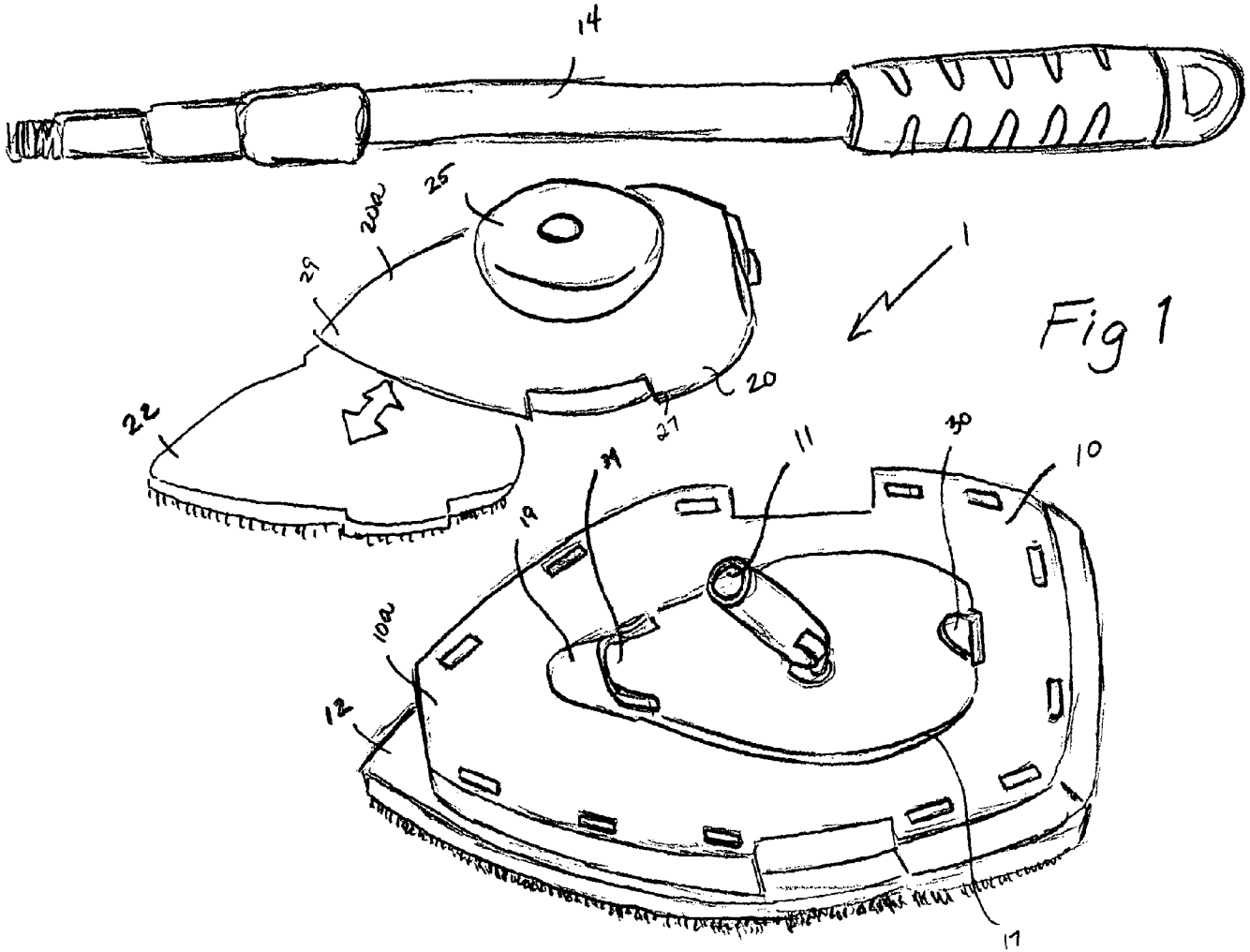
FIG. 1 is a front perspective view of one of the embodiments of the painting application system of the present invention showing the first application device, the second application device and extendable pole.
Figure 2:
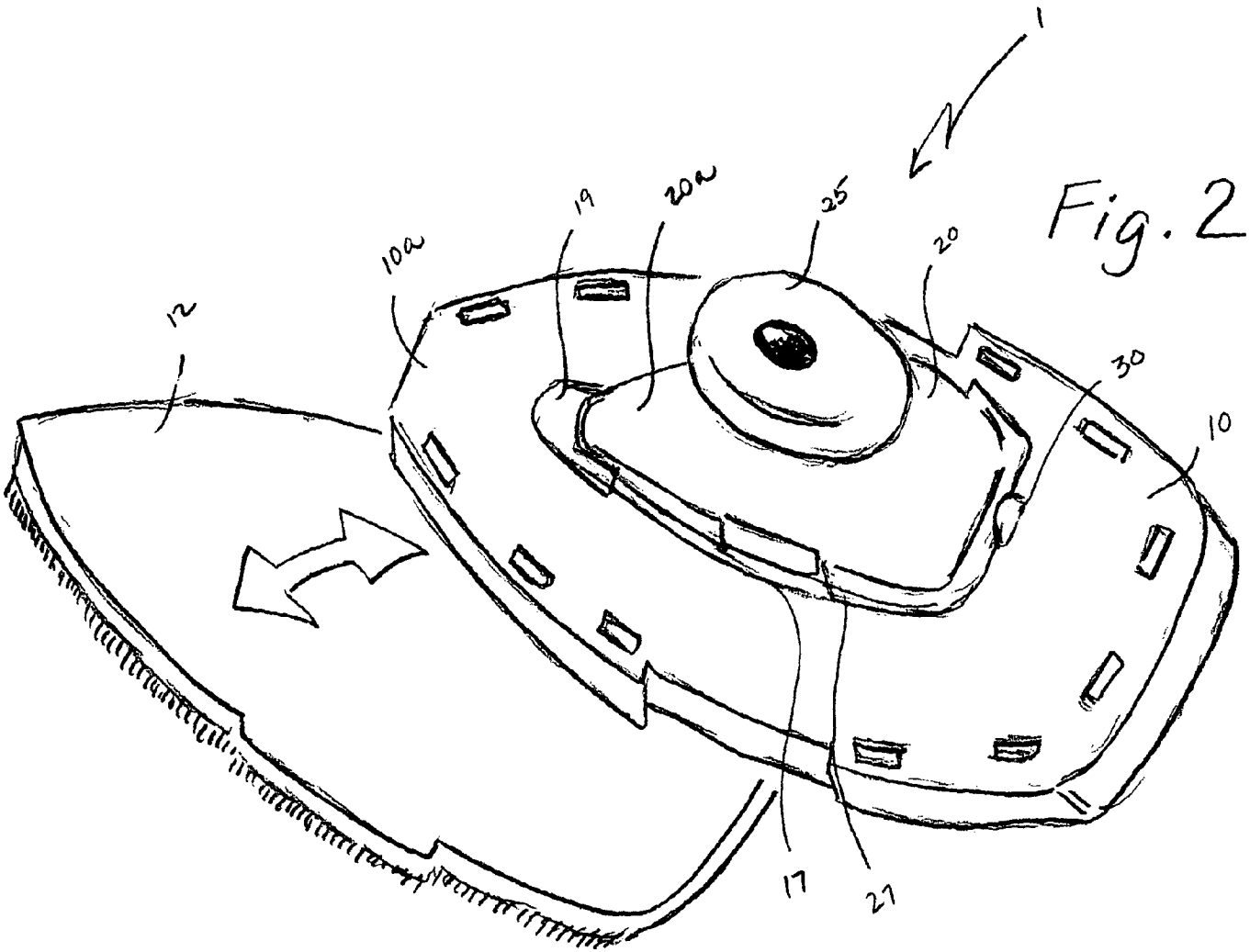
FIG. 2 is a perspective view of the first application device in FIG. 1 with a removable and disposable paint pad.
Figure 3:
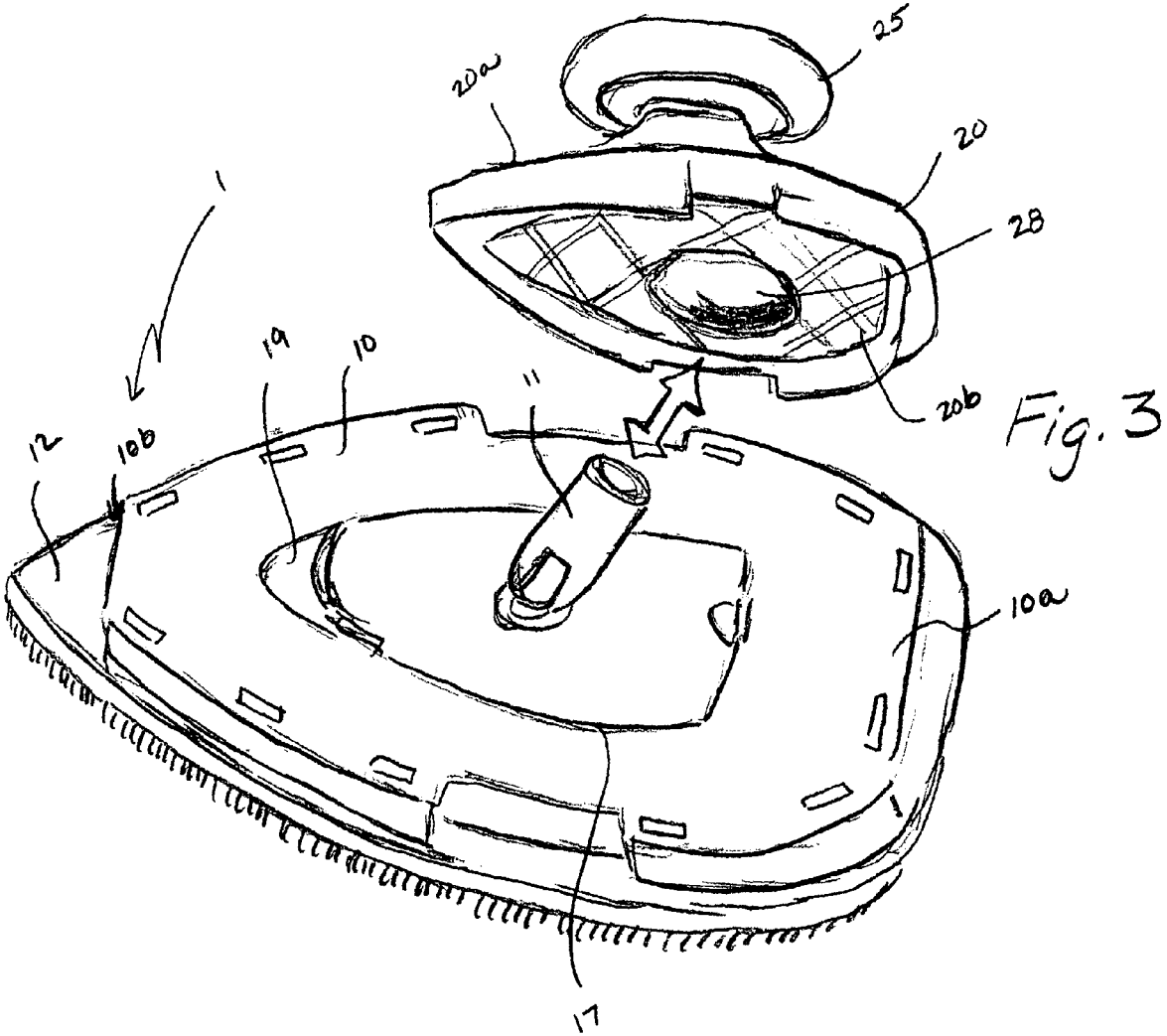
FIG. 3 is a perspective view of the second application device being attached to the first application device of the present invention.

Referring now to FIGS. 1-3, the present invention provides for a painting application system 1. The system 1 comprises first and second application devices, 10 and 20 respectively. The first application device 10 comprises opposing sides 10*a* and 10*b* respectively. The first application device 10 comprises a pole adaptor 11 directly and pivotably attached to the first topside 10*a* of the first application device 10, and the second bottomside 10*b* of the first application device 10 is adaptable to receive a paint pad 12. The second application device 20 comprises opposing sides 20*a* and 20*b* respectively. The second application device 20 comprises a handle 25 situated on the first topside 20*a* of the second application device 20, and the second bottomside 20*b* of the second application 20 has a cavity 27 (shown in FIG. 3) for receiving the pole adaptor 11 when the second application device 20 is attached to the first application device 10.

The system 1 further comprises a first interchangeable paint pad 12 designed to be attached to and removable from the second side 10*b* of the first application device 10. The second side 20*b* of the second application device 20 is adapted to receive a paint pad 21, and the system further comprises a second interchangeable paint pad 22 designed to be attached to and removable from the second side 20*b* of the second application device 20.

The system 1 further comprises a pole 14, and the pole 14 is designed to be attached to the pole adaptor 11 and used with the first application device 10. For shipping and storage purposes, the pole 14 is an extendable pole.

The system 1 further comprises means for attaching 18 the second application device 20 to the first application device 10. The devices shown in FIGS. 1-3 use a snap-on device for securing the second application device 20 to the first application device 10.

The first side 10*a* of the first application device 10 comprises at least one indentation 17 and the second side 20*b* of the second application device 20 comprises at least one protrusion 27, and the protrusion 27 is adapted to fit within the indentation 17 and secure the second application device 20 to the first application device 10.

The first application device 10 further comprises a lock 30, and the lock 30 is situated on the first side 10*a* of the application device 10 and is adapted to engage at least a portion of the second application device 20 to lock the second application device 20 to the first application device 10.

The first side 10*a* of the first application device 10 comprises an extended portion 19, and the extended portion 19 comprises a cavity 39, and at least a portion of the second application device 20 comprises a pointed end 29, and the pointed end 29 of the second application device 20 is adapted to be received within the cavity 39 of the extended portion 19 when the second application device 20 is attached to the first application device 10.

Figure 4:
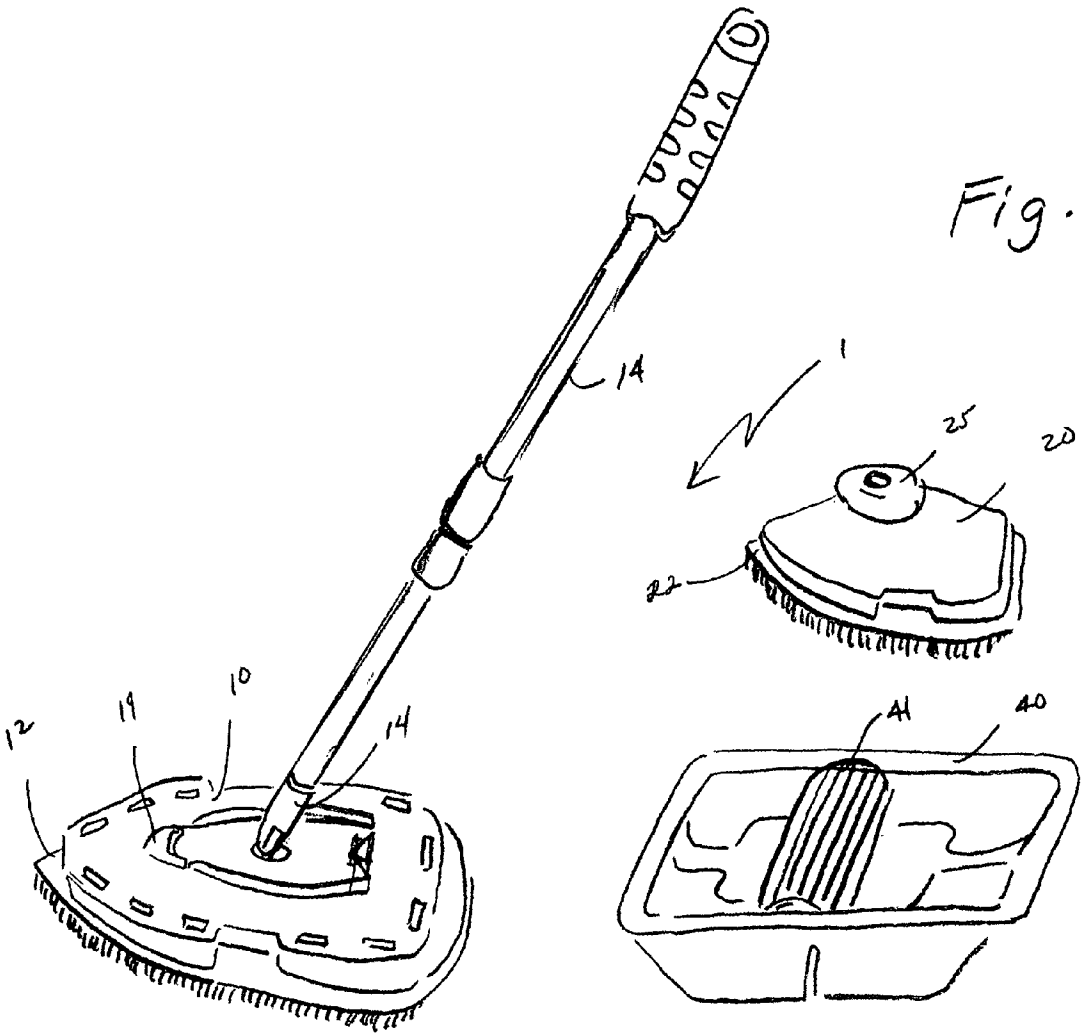
FIG. 4 is a perspective view of the paint application system of the present invention showing the first application device with attached pole, second application device, and a paint tray with roller.

The present invention, as shown in FIG. 4, also relates to a painting system 1 comprising: a first application device 10 comprising opposing sides, 10*a* and 10*b* respectively, the first application device 10 comprises a pole adaptor 11 directly and pivotably attached to the first side 10*a* of the first application device 10; a first paint pad 12 adapted to fit on the second side 10*b* of the first application device 10; a second application device 20 comprising opposing sides, 20*a* and 20*b* respectively; the second application device 20 comprises a handle 25 situated on the first side 20 a of the second application device 20, and the second side 20*b* of the second application 20 has a cavity 27 for receiving the pole adaptor 11 when the second application device 20 is attached to the first application device 10; a second paint pad 22 adapted to fit on the second side 20*b* of the second application device 20 when the second application device 20 is used separately from the first application device 10; and a pole 14 adapted to be attached to the pole adaptor 11 when the second application device 20 is separated from the first application device 10. The system further comprises a tray 40 with a removable wheel 41 for removing excess paint. The pads 12 and 22 are designed to contact the wheel 41 and remove excess paint which is received within the tray 40 and distribute the paint even on the pads 12 and 22.

Figure 5:
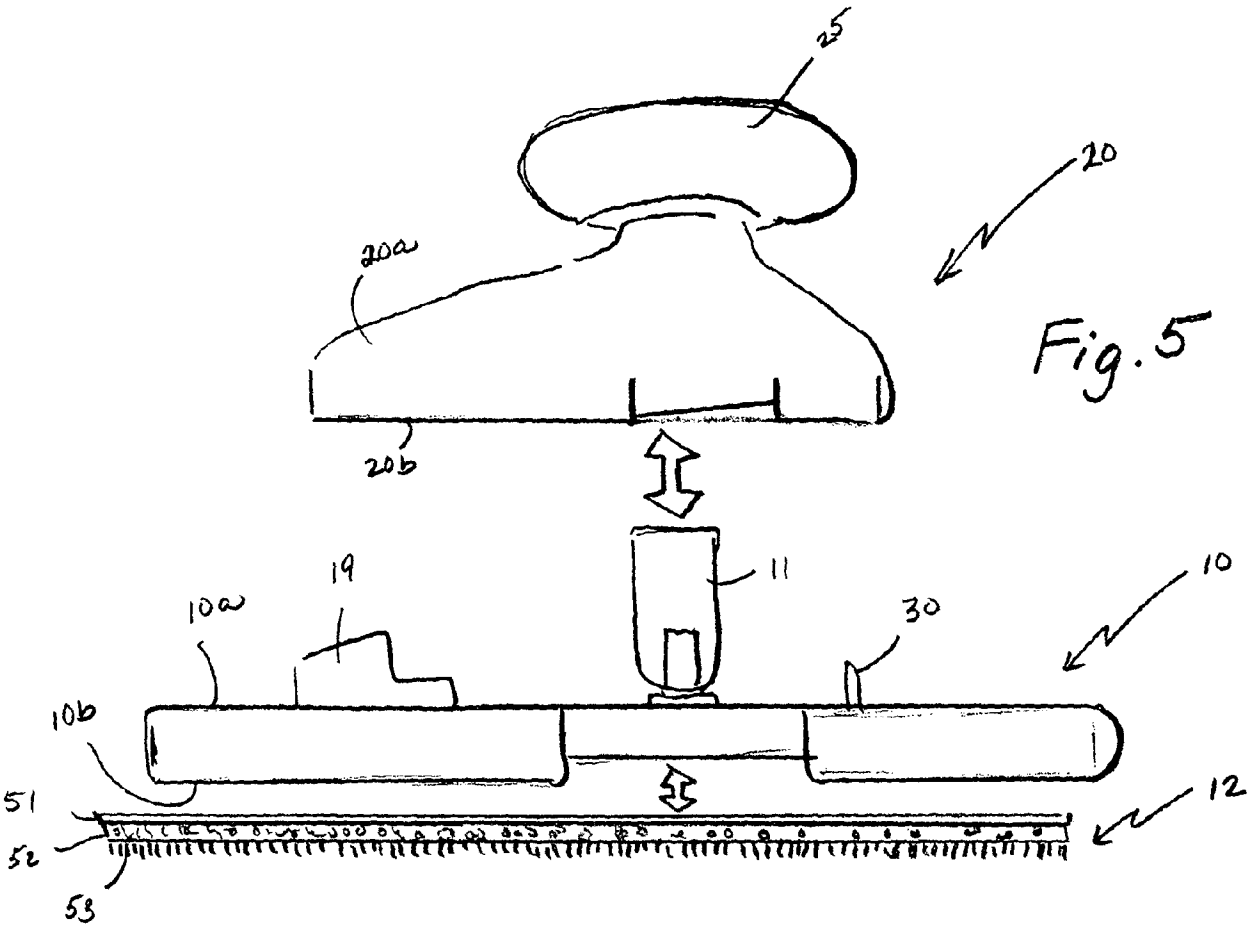
FIG. 5 is a side view of the second paint application device and paint pad being attached to opposing sides of the first application device of the present invention.
Figure 6:
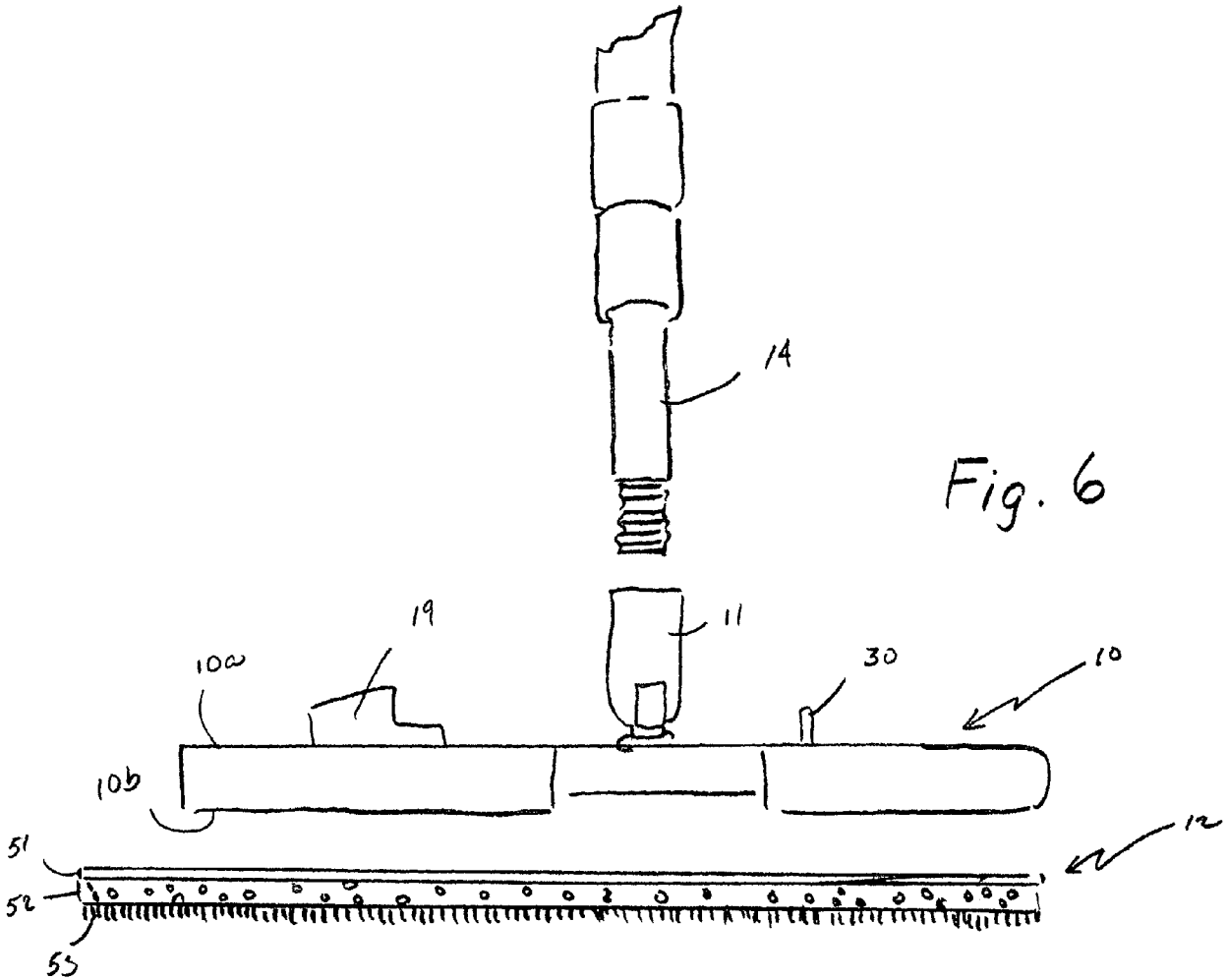
FIG. 6 is a side view of the extendable pole and paint pad being attached to opposing sides of the first application device of the present invention.
Figure 7:
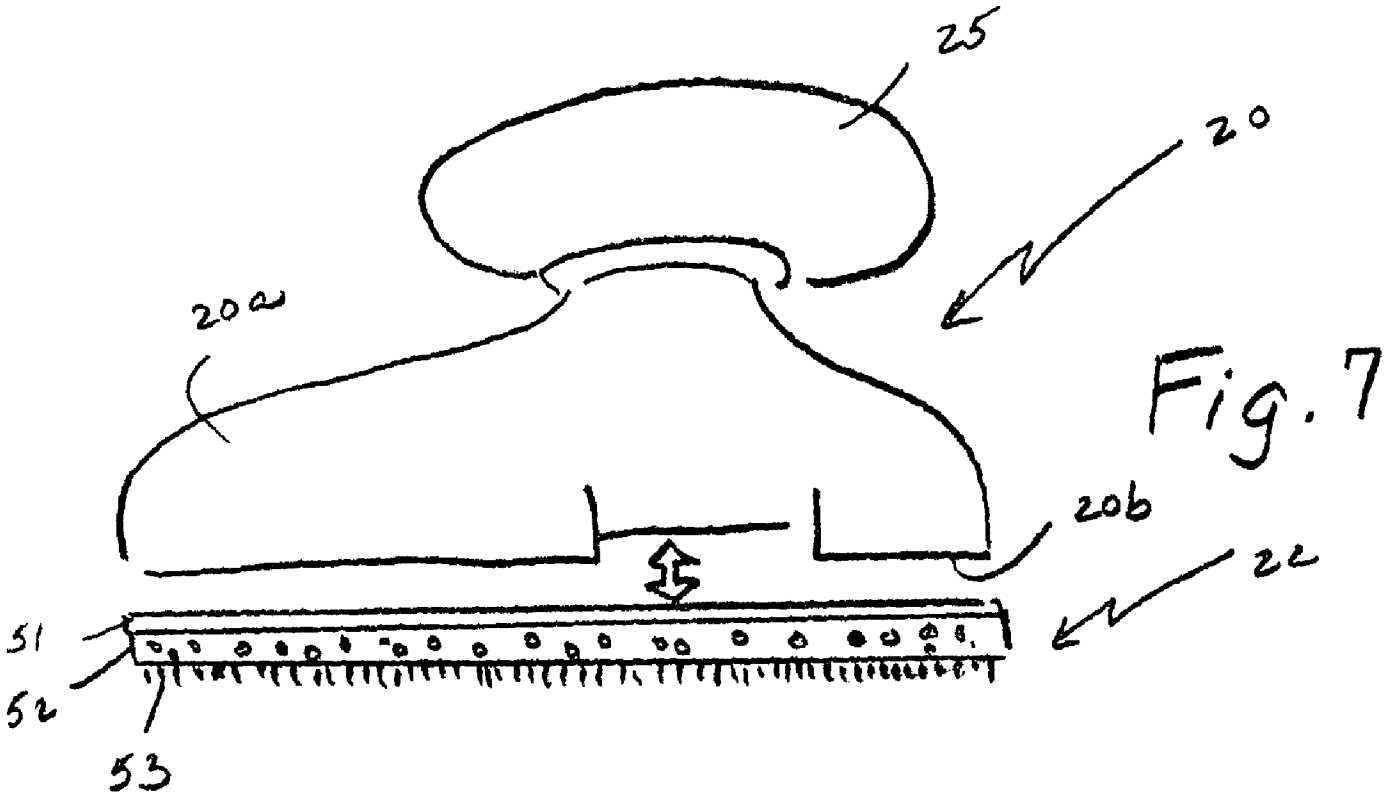
FIG. 7 is a side view of a second paint pad being attached to the second application device of the present invention.

FIGS. 5-7 show side views of the various embodiments of the painting application system 1 of the present invention. FIG. 5 shows the embodiment using the first application device 10, the second application device 20 and first removable and disposable pad 12. In one embodiment, the first and second pads 12 comprise at least three layers: a first hard cardboard layer 51, a second sponge layer 52 and a paint contact layer 53 with bristles. FIG. 5 shows an embodiment when there is a large surface to be painted. The second application device 20 basically begins to function as the handles of the system 1. The smaller second application device 20 is attached to the larger first application device 10 which holds the first pad 12.

FIG. 6 shows another embodiment of the invention using the first application device 10, the first pad 12 and the pole 14. This embodiment is used when there are hard to reach places, in particular, high areas. The pole 14 is attached to the pole adaptor 11 and the pad 12 is attached to the bottomside 10*b* of the first application device 10.

FIG. 7 shows a further embodiment of the invention using the second application device 20 and the second pad 22. This embodiment is utilized in painting narrow or small spaces. The second pad 22 is attached to the bottomside 20*b* of the second application device 20. The user would hold the handle 25 and maneuver the second application device 20 during painting.

In one embodiment, the first and second application devices 10 and 20 have a narrowed tip to reach tight corners and have generally rounded ends. In another embodiment, the devices 10 and 20 are generally tear drop shaped.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A paint application system comprising:

a first application device comprising opposing sides, said first application device comprises a pole adaptor directly and pivotably attached to said first side of said first application device, said second side of said first application device being adaptable to receive a paint pad; and a second application device comprising opposing sides, said second application device comprises a handle situated on said first side of said second application device, said second side of said second application device having a cavity for receiving said pole adaptor when said second application device is attached to said first application device.

2. The system of claim 1 further comprising an interchangeable paint pad designed to be attached to and removable from said second side of said first application device.

3. The system of claim 2 further comprising a pole, and wherein said first application device, said pad and said pole are designed to work as a system for painting.

4. The system of claim 2 wherein said first application device, said pad and said second application device are designed to work as a system for painting.

5. The system of claim 2 wherein at least a portion of said first application device comprises a narrowed end and said pad comprises a pointed end, said pointed end of said pad is situated adjacent to said narrowed end of said first application device when said pad is attached to said first application device.

6. The system of claim 1 wherein said second side of said second application device is adapted to receive a paint pad, said system further comprising an interchangeable paint pad designed to be attached to and removable from said second side of said second application device.

7. The system of claim 6 wherein said second application device and said pad are designed to work as a system for painting.

8. The system of claim 6 wherein at least a portion of said second application device comprises a narrowed end and said pad comprises a pointed end, said pointed end of said pad is situated adjacent to said narrowed end of said second application device when said pad is attached to said second application device.

9. The system of claim 1 further comprising a pole, said pole is designed to be attached to said pole adaptor and used with said first application device.

10. The system of claim 9 wherein said pole is an extendable pole.

11. The system of claim 1 further comprising means for attaching said second application device to said first application device.

12. The system of claim 11 wherein said second side of said second application device is attached to said first side of said first application device.

13. The system of claim 11 wherein said means for attaching said second application device to said first application device is selected from a group consisting essentially of snap-ons, clips, adhesives, slide and lock mechanisms, screws, bolts, hooks and loops, tabs, pins and mixtures thereof.

14. The system of claim 1 wherein said first side of said first application device comprises at least one indentation and said second side of said second application device comprises at least one protrusion, said protrusion is adapted to fit within said indentation and secure said second application device to said first application device.

15. The system of claim 14 wherein said first application device further comprises a lock, said lock being situated on said first side of said application device and is adapted to engage at least a portion of said second application device to lock said second application device to said first application device.

16. The system of claim 1 wherein said first side of said first application device comprises an extended portion, said extended portion comprises a cavity, at least a portion of said second application device comprises a pointed end, said pointed end of said second application device is adapted to be received within said cavity of said extended portion when said second application device is attached to said first application device.

17. The system of claim 1 wherein said second application device is smaller in size relative to said first application device.

18. The system of claim 1 wherein said pole adaptor is rotatable around an axis point situated on said first side of said first application device.

19. A painting system comprising:

a first application device comprising opposing sides, said first application device comprises a pole adaptor directly and pivotably attached to said first side of said first application device;

a first paint pad adapted to fit on said second side of said first application device;

a second application device comprising opposing sides, said second application device comprises a handle situated on said first side of said second application device, said second side of said second application device having a cavity for receiving said pole adaptor when said second application device is attached to said first application device; and a second paint pad adapted to fit on said second side of said second application device when said second application device is separated from said first application device.

20. A painting system comprising:

a first application device comprising opposing sides, said first application device comprises a pole adaptor directly and pivotably attached to said first side of said first application device;

a first paint pad adapted to fit on said second side of said first application device;

a second application device comprising opposing sides, said second application device comprises a handle situated on said first side of said second application device, said second side of said second application device having a cavity for receiving said pole adaptor when said second application device is attached to said first application device;

a second paint pad adapted to fit on said second side of said second application device when said second application device is separated from said first application device; and a pole adapted to be attached to said pole adaptor when said second application device is separated from said first application device.

* * * * *